US006543325B1

(12) United States Patent
Newhouse et al.

(10) Patent No.: US 6,543,325 B1
(45) Date of Patent: Apr. 8, 2003

(54) DRIVE SYSTEM FOR FOOD SLICING MACHINE

(75) Inventors: Scott A. Newhouse, Grove City, OH (US); Darren W. Crow, Columbus, OH (US); Dale Grillot, Gahanna, OH (US)

(73) Assignee: J. E. Grote Company, Inc., Blacklick, OH (US)

( * ) Notice: Subject to any disclaimer, the term of this patent is extended or adjusted under 35 U.S.C. 154(b) by 0 days.

(21) Appl. No.: 09/830,372

(22) PCT Filed: Oct. 29, 1999

(86) PCT No.: PCT/US99/24050

§ 371 (c)(1),
(2), (4) Date: Apr. 25, 2001

(87) PCT Pub. No.: WO00/24552

PCT Pub. Date: May 4, 2000

Related U.S. Application Data

(60) Provisional application No. 60/105,766, filed on Oct. 27, 1998.

(51) Int. Cl.[7] ..... B26D 7/06
(52) U.S. Cl. ..... 83/703; 83/730; 83/932
(58) Field of Search ..... 83/707, 703, 730, 83/932

(56) References Cited

U.S. PATENT DOCUMENTS

| | | | | |
|---|---|---|---|---|
| 4,436,012 A | | 3/1984 | Hochanadel | |
| 4,543,864 A | * | 10/1985 | Hochanadel et al. | 83/703 X |
| 4,960,025 A | * | 10/1990 | Fitch | 83/703 |
| 5,230,267 A | * | 7/1993 | Abler | 83/703 X |
| 5,458,055 A | * | 10/1995 | Fitch, Jr. | 83/703 X |
| 6,044,739 A | * | 4/2000 | Abler et al. | 83/703 X |

* cited by examiner

*Primary Examiner*—Charles Goodman
(74) *Attorney, Agent, or Firm*—Jason H. Foster; Kremblas, Foster, Phillips & Pollick

(57) ABSTRACT

A drive system for driving the workpiece-retaining carriage of a food slicing machine, including a drive pulley rotatably driven by a servomotor in alternating, opposite directions. Opposite ends of a drive belt extend around the drive pulley through a gap between two idle pulleys. The drive belt seats against the idle pulleys and the opposite ends extend in opposite directions on the opposite side of the gap. The upper drive belt end extends over the curved surface of a support panel to gripping engagement of a tensioning pulley and clamp. The lower drive belt end extends over the curved surface of the support panel to gripping engagement of a second tensioning pulley and clamp. The support panel is mounted on a drive member that is, at its opposite end, rotatably mounted to a pivot, and rigidly mounted to the workpiece-retaining carriage.

7 Claims, 3 Drawing Sheets

DRIVE SYSTEM FOR FOOD SLICING MACHINE

This application claims the benefit of provisional application Ser. No. 60/105,766 filed Oct. 27, 1998.

BACKGROUND OF THE INVENTION

1. Field of the Invention

The invention relates to drive systems, and more particularly to drive systems for food slicing machines in which a food product retaining carriage is reciprocatingly driven.

2. Description of the Related Art

In conventional food slicing machines, a workpiece-retaining carriage is reciprocatingly driven for the purpose of reciprocating a food product workpiece, such as a cheese log, through a cutter. The workpiece is cut, forming a slice that falls downwardly due to gravity onto a conveyor, a tray or another food product, such as a slice of bread or pizza crust. After the slice is formed, the workpiece is driven back across the cutter, dropping downwardly so that another slice can be formed. The operation of the slicing machine is cyclical, with a cutting stroke during the first half of the cycle and the return stroke in the second half of the cycle.

The workpiece-retaining carriage is linked to a drive mechanism. Conventional drive mechanisms are hydraulic rams, and cranks connected to rotary motors, both of which are described in U.S. Pat. No. 4,436,012. Both of these drive mechanisms mount to the workpiece-retaining carriage near where the food product is retained. This configuration has the disadvantage that drive system parts and lubricants must be made of food grade materials, and must be washable by the means used to wash the carriage.

The displacement of the carriage by the rotary motor and crank mechanism approximates sinusoidal motion. This sinusoidal motion has large variations in the speed of the workpiece during the formation of slices. These large variations result in inaccuracies in the formed slices.

Additionally, the width of the motor and crank mechanism is greater than the width of the carriage. This configuration makes placing multiple carriages in a close, side-by-side relationship unfeasible.

Therefore, the need exists for a carriage drive system that can be adjusted to control the accuracy of formed slices. The drive system should also be mounted in a position that keeps moving parts away from the region of the food product workpiece to avoid the necessity of expensive materials and frequent washing. Furthermore, the drive system should be narrow enough that several carriages can be mounted in close proximity without interference between moving parts.

SUMMARY OF THE INVENTION

The invention is an improved drive system for a food product slicing machine. The slicing machine with which the drive system cooperates has a frame, and a workpiece-retaining carriage attached to the frame. The carriage retains a food product workpiece therein, and reciprocates the workpiece through a path including a cutter.

The drive system includes a drive member pivotably mounted to the machine frame about a pivot, such as a pivot pin. A support panel mounts to the drive member, and has a curved surface spaced from the axis. This space is substantially equal to a radius of curvature of the curved surface. The curved surface has first and second sides.

First and second idle pulleys are connected to the machine frame, with the second idle pulley spaced from the first, forming a gap. A drive pulley is drivingly linked to a rotatably driven shaft of a prime mover, preferably through a gear mechanism. An elongated, flexible drive means, preferably a belt, loops around the drive and idle pulleys. The first end of the drive belt extends from attachment to the drive member, near the first side of the support panel's curved surface. The belt extends through the gap between the first and second idle pulleys, around the drive pulley, and through the gap. The second end attaches to the drive member near the second side of the support panel's curved surface.

When the prime mover's shaft rotates in one direction, the drive belt is driven in the same direction, applying a force to one side of the support panel and drive member. The drive member is displaced in one direction, pivoting about the pivot axis and swinging the workpiece-retaining carriage through an arcuate path. Upon reaching its extreme, the prime mover stops the drive shaft's rotation and reverses its direction, thereby swinging the workpiece-retaining carriage through the arcuate path in the opposite direction.

By continuously reversing the prime-mover's direction of rotation, the workpiece-retaining carriage is reciprocated through the arcuate path, thereby reciprocating a food product workpiece retained within the carriage through a cutting blade, forming slices. The prime mover provides a much more consistent velocity during cutting, which results in consistent slice thickness and spacing of multiple slices. Furthermore, because of the configuration of the drive system, several workpiece-retaining carriages can be mounted in a small space.

Figure 1:
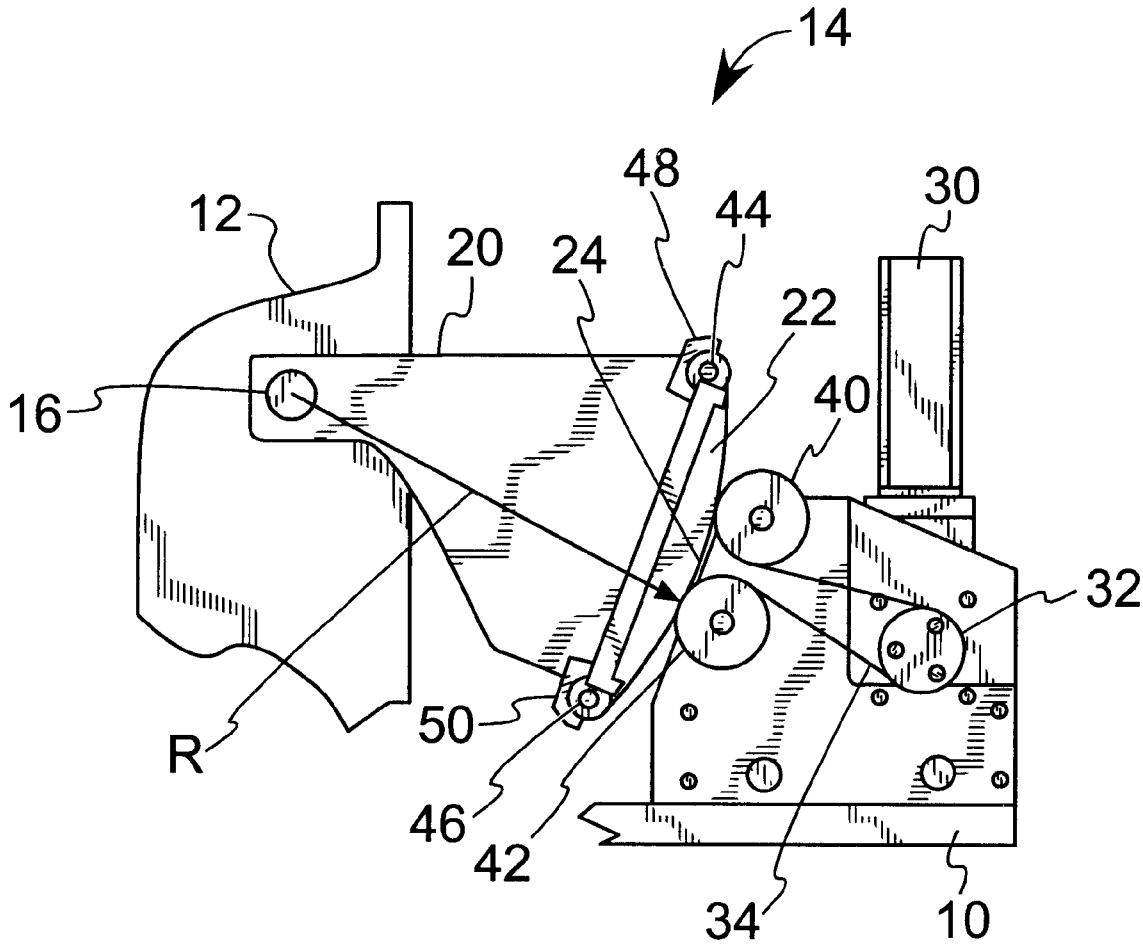
FIG. 1 is a side view illustrating the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF THE PREFERRED EMBODIMENT

Figure 2:
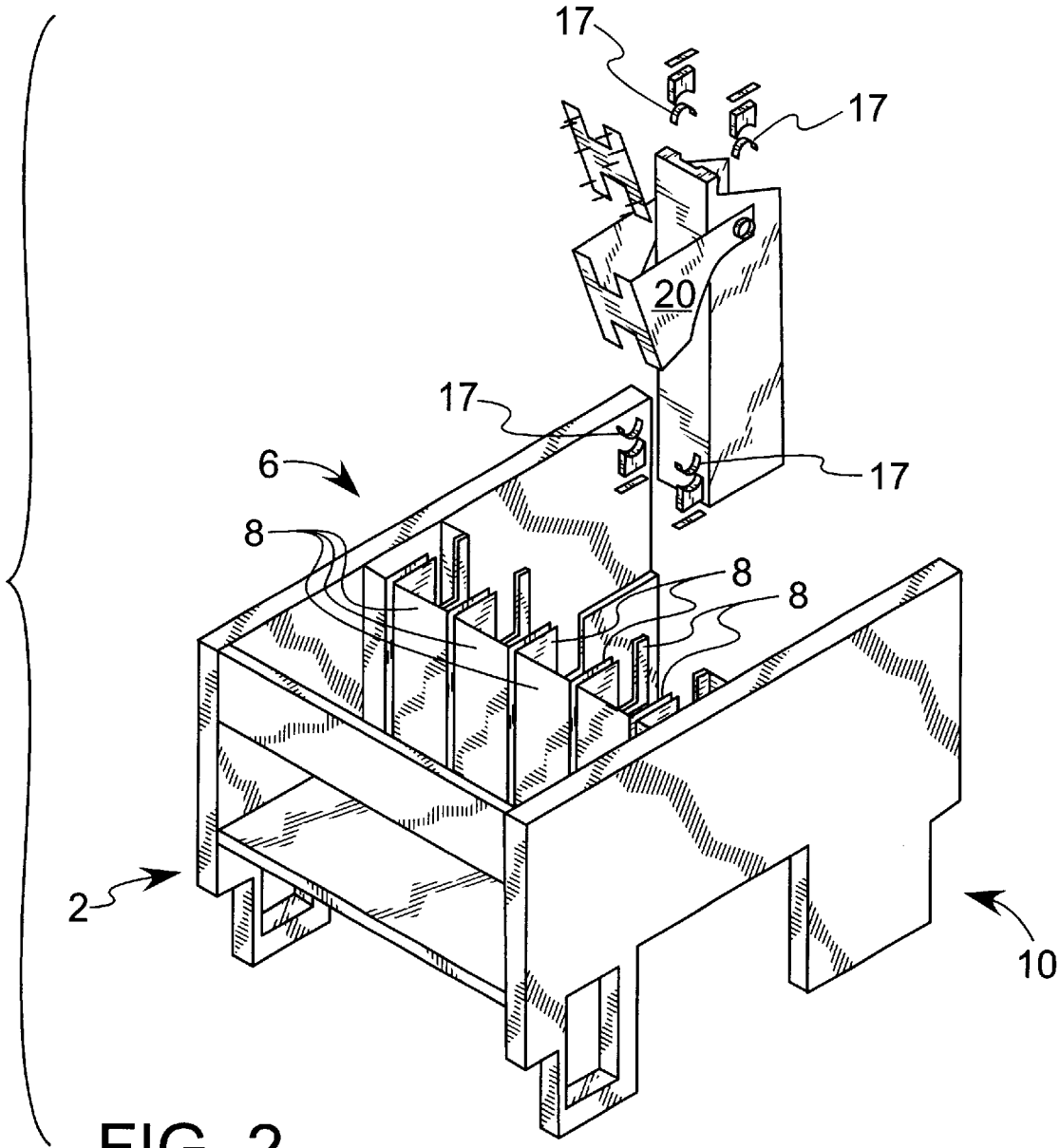
FIG. 2 is a view in perspective illustrating a portion of the present invention, and its mounting position on the slicing machine.

The preferred embodiment is shown in FIGS. 1 and 2, in which a workpiece-retaining carriage, preferably the cluster box 12, is rotatably mounted to the frame 10 of the food product slicing machine 14. The frame 10 encompasses many, but not all, regions of the machine 14, and includes any of the structural components that make up the base, backbone or housing of the machine 14 (shown in FIG. 2). The machine 14 includes the frame 10, and all other parts connected to the frame 10.

The cluster box 12 is, in its operable position, inserted into one of the chambers formed between the panels 8, which are part of the frame 10. The cluster box 12 is rigidly mounted to the pivot shafts 16, and the pivot bushings 17 are mounted between the pivot shafts 16 and the panels 8. The cluster box 12 is driven in a pendulum motion about the pivot shafts 16, and the food workpiece, which could be one food log or several food logs as shown in FIG. 5, is retainer in the cluster box 12, protruding from the lower end where slices are formed in the food slicing area 6 shown in FIG. 4.

The drive member 20 is rigidly mounted to the cluster box 12 at the pivot shafts 16, permitting simultaneous oscillating rotation of the drive member 20 and the attached cluster box 12 about the axis of the pivot shafts 16. The drive member 20 is driven upwardly and downwardly in reciprocating motion about the pivot shafts 16 as described below, and this motion drives the cluster box 12 in its slicing reciprocation.

The support panel 22 is rigidly mounted to the end of the drive member that is preferably farthest from the pivot shafts 16. The curved surface 24 of the support panel 22 faces away from the pivot shafts 16, and has a radius of curvature, R, substantially equal to the distance between the curved surface 24 and the axis of the pivot shafts 16. The radius, R, is preferably between about 12 and 18 inches, but could be larger or smaller. Generally, a larger radius, R, permits greater precision in moving the cluster box 12.

A prime mover, preferably, but not necessarily, the servomotor and gear box 30 is mounted to the frame 10 at a point spaced from the pivot shaft 16. The drive pulley 32 is connected to the gear box, which attaches to the drive shaft of the servomotor, preferably by directly mounting thereto, but alternatively connecting through any conventional linkage. The drive pulley 32 preferably has teeth formed in its outer, circumferential surface for inserting between, and engaging, the corresponding teeth on the inner surface of the drive belt 34, which is preferably a toothed timing belt. The preferred drive belt 34 could be substituted by any conventional flexible, or hinged, means, such as a drive chain or rope, as long as the cooperating structures accommodate it.

The drive belt 34 extends around the drive pulley 32 into a gap between first and second idle pulleys 40 and 42. The idle pulleys 40 and 42 are rotatably mounted to the frame 10 between the support panel 22 and the drive pulley 32. A gap is formed between the closest parts of the outer circumferential surfaces of the idle pulleys. The idle pulleys guide the opposing ends of the drive belt 34, that extend through the gap in opposite directions, toward opposite sides of the support panel 22. The surfaces of the segments of the drive belt 34 that extend between the idle pulleys and the support panel 22 seat against the curved surface 24 of the support panel 22.

Tensioning pulleys 44 and 46 are mounted at opposite sides of the support panel 22 for grippingly engaging the toothed surfaces of the opposing ends of the drive belt 34 between the tensioning pulleys 44 and 46 and the clamps 48 and 50.

From one end to the other, therefore, the drive belt 34 extends from gripping engagement between the tensioning pulley 44 and the clamp 48, seating against the upper side of the curved surface 24 of the support panel 22, and into the gap between the idle pulleys 40 and 42. The drive belt seats against the circumferential surface of the idle pulley 40 and spans the distance to the drive pulley 32, around which the drive belt 34 extends. From the drive pulley 32, the drive belt extends the distance back through the gap between the idle pulleys, seating against the idle pulley 42. The drive belt extends from the idle pulley 42 to the curved surface 24 and seats against it, extending along it to clamping engagement between the tensioning pulley 46 and the clamp 50. Of course, the drive belt 34 could be an endless loop that, instead of attaching at opposite sides of the support panel 22, attaches at one point at or between the tensioning pulleys 44 or 46.

During operation, the servomotor and gear box 30 apply a rotary force to the drive pulley 32 in one direction. A tensile force is thus applied to one end of the drive belt 34 by the drive pulley. This tensile force is applied through the drive belt to one of the tensioning pulleys gripping the belt at one side, for example the tensioning pulley 44 on the top side, of the belt support panel 22. The tensile force applied to the end of the belt support panel rotates the drive member 20 around the pivot shafts 16, rotating the attached cluster box 12 in one half of the cutting cycle, which is to the left in the example and as shown in FIG. 1.

Once the cluster box 12 is displaced a predetermined distance to the left, the servomotor and gear box 30 rapidly stops rotating the drive pulley. The drive pulley is then driven in the opposite direction. The drive pulley 32 applies a tensile force to the opposite end of the belt, thereby applying a tensile force to the opposite side, for example the tensioning pulley 46 on the lower side, of the belt support panel 22. This produces an upwardly directed force that displaces the cluster box 12 in the opposite direction for the other half of the cutting cycle, which is to the right in the example and as shown in FIG. 1.

The length of the stroke the cluster box 12 is driven through is controlled by the servomotor. The degree of rotation of the servomotor's drive shaft determines the distance the drive member 20 is displaced, and therefore the distance the cluster box 12 is displaced. A center sensor, which is not shown, detects the center point of the stroke, and signals a central computer of the presence of the cluster box 12 at the center point. This sensor is used to calibrate the system, so that the servomotor's driveshaft position is noted at the moment the computer is signalled that the cluster box is centered. Then the distance the drive member 20 must be driven from center can be determined mathematically by the computer based upon the geometric dimensions (such as the radius, R, the gear box ratio, etc.) of the drive system. The distance the cluster box 12 is driven is then controlled by the computer controlling the degree of rotation of the servomotor's driveshaft.

Sensors at opposite extremes of the center signal the computer if the cluster box 12 has exceeded the normal path, or if, to avoid damage, the cluster box 12 must be stopped from further motion in the present direction. It is preferred that the stroke of the present invention be variable from four to 12 inches.

The drive belt 34, once adjusted in tension by rotating the tensioning pulleys 44 and 46, does not loosen or tighten during the operating cycle. This is due to the relationship between the curvature of the curved surface 24 of the support panel 22 and the motion of the drive member 20. Because the radius of curvature, R, of the curved surface 24 is substantially equal to the distance from the curved surface 24 to the axis of the pivot shafts 16, and because the drive belt between the idle pulleys 40 and 42 and the curved surface stays seated against the curved surface 24, the drive belt 34 maintains the same tension during the movement of the drive member 20 from one extreme to the other.

The outer circumferential surfaces of the idle pulleys 40 and 42 that are closest to the curved surface 24 are spaced slightly from the curved surface 24 to permit the drive belt 34 to pass through the spaces. The close proximity of the idle pulley surfaces and the curved surface 24 prevents slackening of the drive belt 34 during operation, which would occur if the spaces were significantly greater than the thickness of the drive belt 34.

Figure 3:
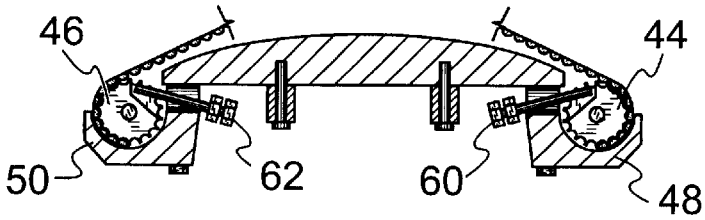
FIG. 3 is a side view in section illustrating the preferred tensioning pulleys and adjustment mechanisms.

The tensioning pulleys 44 and 46 have tension adjustment screws 60 and 62, respectively, as shown in FIG. 3. Once the opposite ends of the drive belt are positioned between the tensioning pulleys 44 and 46 and the clamps 48 and 50, the screws 60 and 62 can be adjusted to change the tension on the drive belt 34. The ends of the screws 60 and 62 contact curved inner cam surfaces on the tensioning pulleys, which causes slight rotation of the tensioning pulleys upon rotation of the screws 60 and 62. Of course, other adjustment mechanisms are contemplated as being equivalent to the preferred structure.

One advantage of the drive system of the present invention is the ability to create a trapezoidal velocity curve with the servomotor. Conventional drive systems, such as a crank and motor, approximate sinusoidal motion, which does not provide slices that are as accurately patterned as with the trapezoidal velocity curve. This is because variations in workpiece velocity are minimal or nonexistent except at the extremes of the cycle, whereas with a sinusoidal motion variations are significant throughout.

The advantage of a trapezoidal velocity curve is most apparent when slicing a group of food logs, such as those shown in FIG. 5. Because the velocity of the cluster box is essentially constant during cutting, the food slices that fall from the cluster box fall onto a substrate, such as a pizza crust, in an even slice pattern. Without the constant velocity, the spacing would be uneven, resulting in an uneven slice pattern. Sinusoidal motion of the prior art machines produces a slice pattern with closely spaced slices formed initially, greater spacing between the middle slices, and close spacing nearer the end of the slice. Such spacing is more noticeable the longer the stroke. With the present invention, slice patterns are significantly improved.

Additionally, the drive system of the present invention is narrower than conventional drive mechanisms, and this permits several cluster boxes to be grouped very closely together.

Figure 4:
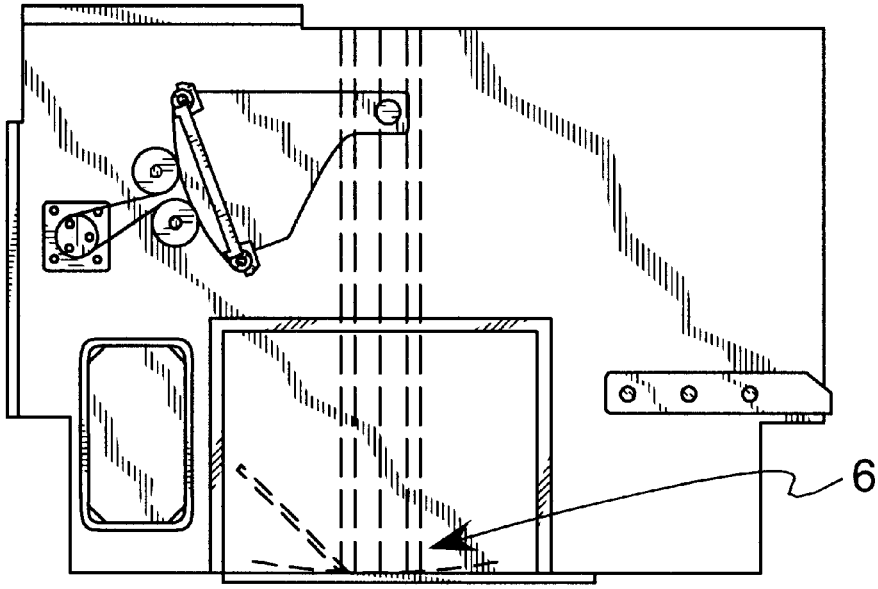
FIG. 4 is a side view illustrating the present invention.
Figure 5:
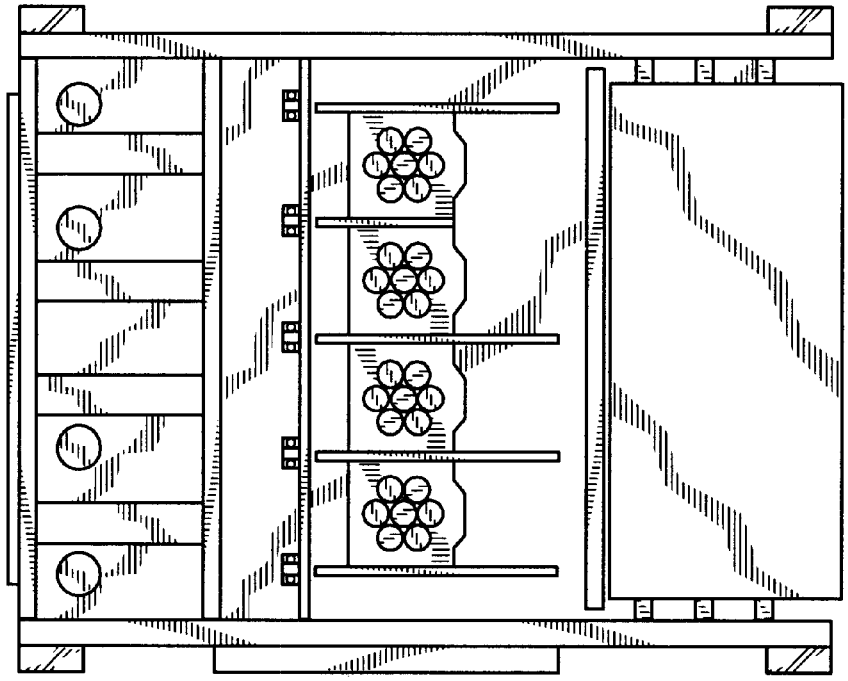
FIG. 5 is a top view illustrating the present invention.

Furthermore, each drive system can be housed in the drive system region 2 shown in FIG. 2, which is separated from the food slicing area 6, shown in FIG. 4. This separation allows the drive system parts to be made of any material, and eliminates the need to clean the drive system in the same manner as food-contacting parts of the slicing machine.

While certain preferred embodiments of the present invention have been disclosed in detail, it is to be understood that various modifications may be adopted without departing from the spirit of the invention or scope of the following claims.

What is claimed is:

1. A drive system for a food product slicing machine having a frame and an attached workpiece-retaining carriage for reciprocating the food product workpiece retained therein through a path including a cutter, the drive system comprising:

(a) a drive member drivingly linked to the workpiece-retaining carriage and pivotably mounted to the machine frame about a pivot axis;

(b) a support panel mounted to the drive member, the support panel having a circularly curved surface spaced from the pivot axis a distance substantially equal to a radius of curvature of the curved surface, said curved surface having first and second opposing ends;

(c) a first idle pulley rotatably mounted to the machine frame;

(d) a second idle pulley rotatably mounted to the machine frame spaced from the first idle pulley, forming a gap;

(e) a drive pulley drivingly linked to a rotatably driven shaft of a prime mover; and (f) an elongated, flexible drive means having first and second ends, the first drive means end extending from attachment to the drive member, near the first end of the support panel's curved surface, through the gap between the first and second idle pulleys, around the drive pulley, through the gap, the second drive means end attached to the drive member near the second end of the support panel's curved surface.

2. A drive system in accordance with claim 1, wherein the drive member is rigidly mounted to the workpiece-retaining carriage near a first drive member end, the support panel is rigidly mounted to the drive member near a second, opposing drive member end, and the pivot axis is positioned between the first and second drive member ends.

3. A drive system in accordance with claim 1, wherein the elongated, flexible drive means is a belt.

4. A drive system in accordance with claim 3, wherein a first belt gap is formed between the curved surface of the support panel and a closest peripheral edge of the first idle pulley, and a second belt gap is formed between the curved surface of the support panel and a closest peripheral edge of the second idle pulley, said first and second belt gaps being substantially equal to a drive belt thickness.

5. A drive system in accordance with claim 3, wherein the belt has alternating ridges and grooves forming a toothed surface.

6. A drive system for a food product slicing machine having a frame and an attached workpiece-retaining carriage for reciprocating the food product workpiece retained therein through a path including a cutter, the drive system comprising:

(a) a drive member having a first end rigidly mounted to the workpiece-retaining carriage and a second, opposing end, said drive member being pivotably mounted to the machine frame about a pivot axis positioned between the first and second drive member ends;

(b) a support panel mounted near the second end of the drive member, the support panel having a circularly curved surface spaced from the pivot axis a distance substantially equal to a radius of curvature of the curved surface, said curved surface having first and second opposing ends;

(c) a first idle pulley rotatably mounted to the machine frame;

(d) a second idle pulley rotatably mounted to the machine frame spaced from the first idle pulley, forming a gap;

(e) a drive pulley drivingly linked to a rotatably driven shaft of a prime mover that is mounted to the machine frame; and (f) an elongated, flexible drive belt having first and second ends, the first belt end extending from attachment to the drive member, near the first end of the support panel's curved surface, through the gap between the first and second idle pulleys, around the drive pulley, through the gap, the second belt end attached to the drive member near the second end of the support panel's curved surface.

7. A drive system in accordance with claim 6, further comprising a split pivot bushing mounted between the pivot axis and the machine frame.

* * * * *